US007645979B2

(12) United States Patent
Rozenblum et al.

(10) Patent No.: US 7,645,979 B2
(45) Date of Patent: Jan. 12, 2010

(54) OPTICAL DETECTION FOR LOW OPTICAL DENSITY WEB

(75) Inventors: Ziv Rozenblum, Rehovot (IL); Erez Segal, Rehovot (IL); Haim Belinkov, Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 323 days.

(21) Appl. No.: 11/406,711

(22) Filed: Apr. 19, 2006

(65) Prior Publication Data

US 2007/0247626 A1 Oct. 25, 2007

(51) Int. Cl.
*H01J 40/14* (2006.01)

(52) U.S. Cl. ..... 250/223 R; 250/221; 250/559.03; 493/10; 226/42

(58) Field of Classification Search ..... 250/559.01, 250/559.02, 559.03, 221, 223 R; 493/10, 493/13; 226/42, 97, 111, 113, 97.3; 242/417
See application file for complete search history.

(56) References Cited

U.S. PATENT DOCUMENTS 3,807,612 A * 4/1974 Eggert ..... 226/42

* cited by examiner

*Primary Examiner*—Kevin Pyo

(57) ABSTRACT

Apparatus for buffering of a web feed system using feedback based on the amount, or extent, of loop of the web within a buffering module. The extent of the loop is measured optically. An opaque extensor is inserted within the loop to mark the extent of the loop so as to enable the optical sensor to work accurately even if the web is transparent.

10 Claims, 4 Drawing Sheets

OPTICAL DETECTION FOR LOW OPTICAL DENSITY WEB

FIELD AND BACKGROUND OF THE INVENTION

The present invention relates to optical detection for low optical density web and, more particularly, but not exclusively to such optical detection that is suitable for all optical densities including the very low densities, without requiring adjustments. The optical detection system is preferably suitable for inclusion within a web feeder system and in particular to inclusion within the buffer of a variable speed web feeder system.

In web feeder systems it is necessary to sense the presence of the web so that the feeder system knows whether the web is being fed correctly. Sensing of web at the wrong location, or failure to sense the web at the correct location can be used as a trigger to interrupt the feed.

Furthermore the web feeder system typically feeds the web to a web utilizing component located downstream of the feeder system. The web utilizing component is typically but not exclusively a printing engine. The web utilizing component may require temporary variations in the rate at which the web is fed. A printer may require the web to be stopped at certain locations before starting a new printing image. In certain cases the web may actually be moved backwards.

Alternatively certain parts of a complex layout may require different feed rates. Thus a layout including a banner headline followed by a high resolution image would require the web to be fed relatively fast while the banner part is printed and relatively slowly while the high resolution image is printed.

Generally the web feeding rollers at the printer react rapidly to any change in feed requirements. However the web feeder system reacts more slowly to these changes and thus web buffering capacity is provided to match between the two. Typically the web buffering capacity is provided by a component known as a vacuum box. The vacuum box sits in the web feeding path and takes up additional web in the form of slack. A loop of the web enters the vacuum box at a first end and is pulled by a vacuum towards a second end in such a way that the length of the loop towards the second end can be varied according to the instantaneous need for buffering. The variability in the length of the loop serves to buffer the web, so that instantaneous changes in feed rate can be absorbed by adding to or reducing from the loop.

In order for the vacuum box to work, it is necessary for the current length of the loop to be known to the feeding control apparatus, so that the length can be controllably varied. Contact sensors are not ideal since the loop does not generally come into contact with the walls of the box but rather sits in the space within the box where it is drawn to the far wall by vacuum. Non-contact sensors are typically used and these include both optical sensors and ultrasound sensors. Optical sensors work by shining light from a sensor at one side of the box through the space of the box to a reflector at the far end. If the loop is absent then a return beam is sensed. If the loop is present then no return beam is sensed since the light never reaches the reflector.

A difficult with optical detection is that the web being fed is not necessarily opaque but can be of any optical density. Web materials include many transparent materials, and in some cases feeders may be required to feed different materials at different times, the materials having different levels of opacity.

One solution to the above is to increase the sensitivity of the optical detectors so that even the relatively minimal light scattering brought about by the most transparent web will be detected. A difficulty with this approach is that it is very susceptible to noise. The difference between a light level indicating detection and that indicating non-detection is small and therefore noise due say to light dust may lead to false detections. Furthermore, for a feeder that is used for feeding web of different opacity, the user would be advised to alter the sensitivity depending on the web material being fed. Such a requirement goes against the overall aim of making the system simpler to use.

Another solution is to dispense with optical detection altogether and use ultrasound. Ultrasound has the advantage that all web materials are sufficiently opaque to the signal but the detectors are expensive, and three detectors are generally required per vacuum box in order to make the control system effective.

There is thus a widely recognized need for, and it would be highly advantageous to have, a detector system for a web buffer which is devoid of the above limitations.

SUMMARY OF THE INVENTION

According to one aspect of the present invention there is provided a non-Contact Detection Apparatus comprising:

an optical sensing unit placed about a void to detect substances within said void through optical interaction;

an opaque extensor for extending within said void with said substances to increase optical interaction of said substances; thereby to ensure optical interaction irrespective of a transparency level of said substances.

According to a further aspect of the present invention there is provided apparatus for buffering within a web feed system using feedback based on an extent of a loop of web material within a buffering module, the apparatus comprising:

an optical detector for optically detecting the extent of the loop, an opaque extensor inserted within the loop to mark the extent of the loop, the extensor providing an opaque barrier within the loop thereby to allow the optical sensor to work accurately even if the web is transparent.

According to a yet further aspect of the present invention there is provided a method of optical sensing of an extension degree of transparent web material comprising:

inserting an opaque extensor within said extension of transparent material such that said extensor reaches said extension degree; and optically sensing said opaque extensor.

According to yet another aspect of the present invention there is provided a vacuum box for buffering a web feed, comprising:

an internal void for receiving a variable extent of loop of web;

an optical sensing system for detecting a current extent of said loop within said void; and an opaque extensor for extending within said loop, thereby to render said current extent detectable to said optical sensing system irrespective of an optical density of said web.

Unless otherwise defined, all technical and scientific terms used herein have the same meaning as commonly understood by one of ordinary skill in the art to which this invention belongs. The materials, methods, and examples provided herein are illustrative only and not intended to be limiting.

Implementation of the method and system of the present invention involves performing or completing certain selected tasks or steps manually, automatically, or a combination thereof. Moreover, according to actual instrumentation and equipment of preferred embodiments of the method and system of the present invention, several selected steps could be implemented by hardware or by software on any operating system of any firmware or a combination thereof. For example, as hardware, selected steps of the invention could be implemented as a chip or a circuit. As software, selected steps of the invention could be implemented as a plurality of software instructions being executed by a computer using any suitable operating system. In any case, selected steps of the method and system of the invention could be described as being performed by a data processor, such as a computing platform for executing a plurality of instructions.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in order to provide what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE PREFERRED EMBODIMENTS

Figure 1:
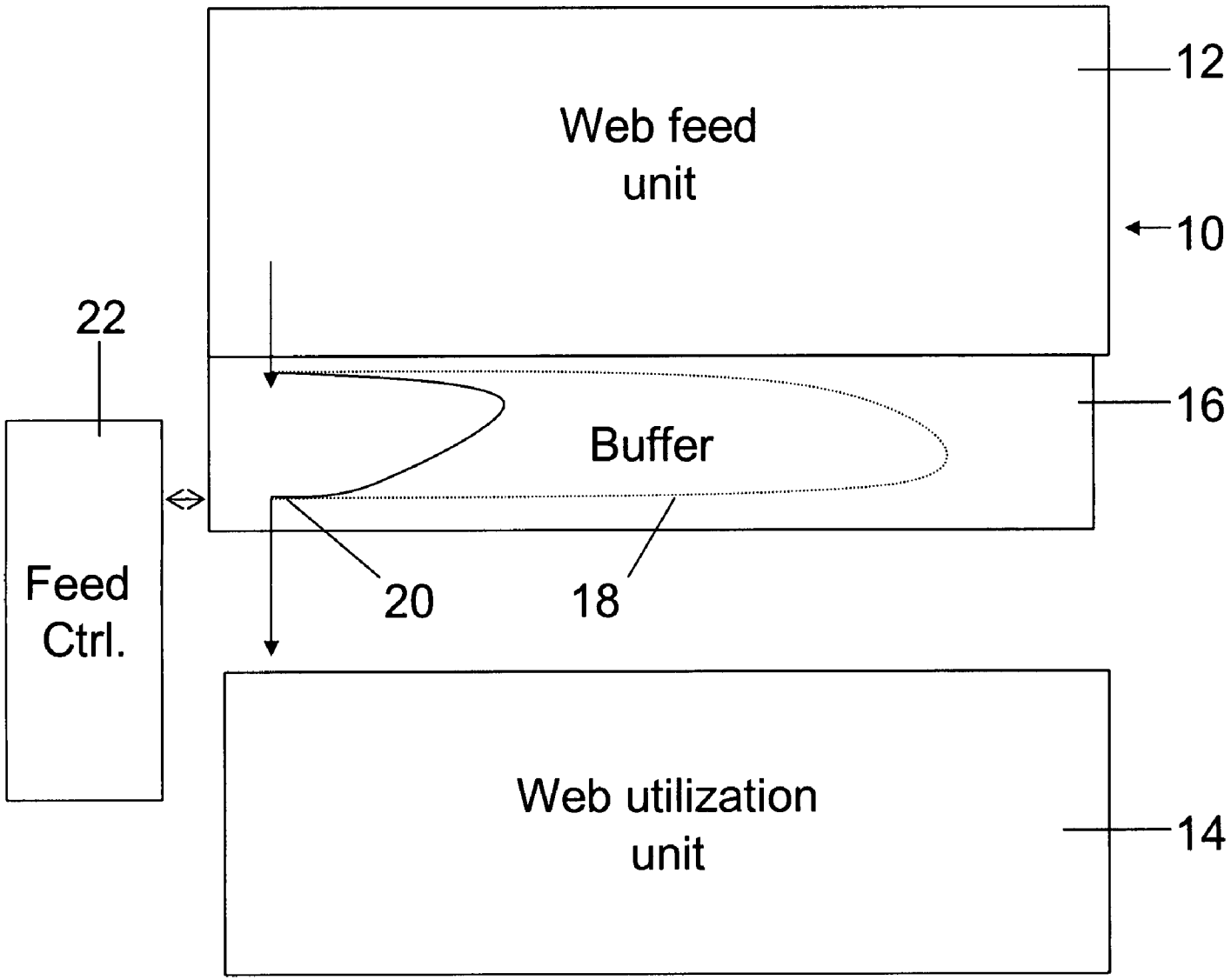
Fig. 1 Prior Art
FIG. 1 is a simplified block diagram that shows a prior art web feed and utilization system with buffering.

The present embodiments comprise an apparatus and a method for buffering of a web feed system using feedback based on the amount, or extent, of loop of the web within a buffering module. The extent of the loop is measured optically. An opaque extensor is inserted within the loop to mark the extent of the loop so as to enable the optical sensor to work accurately even if the web is transparent.

The principles and operation of an apparatus and method according to the present invention may be better understood with reference to the drawings and accompanying description.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Reference is now made to FIG. 1, which is a simplified diagram illustrating a prior art web feeding and utilization system 10. The web feeding and utilization system 10 comprises a web feed unit 12 which feeds web at a required rate. The rate can be changed but response is not instantaneous. The web feed unit 12 feeds web to a web utilization unit 14 such as a printing device. The web utilization device takes web at variable speeds. Thus the web utilization device may print at different speeds or it may stop between printing spreads or it may even momentarily reverse the feed direction. The web utilization device may alter the feed faster than the feed unit 12 is able to react and therefore a certain amount of slack web is held in a buffer module 16 which allows for feed speed discrepancies to be ironed out.

The buffer module 16 holds a loop of the web material in such a way that the loop can vary between a maximal extent indicated by dotted line 18 or to a minimal extent indicated by solid line 20. A feed control system 22 operates to control the extent of the loop to vary between the two indicated extremes but no further.

In order for the feed control system to work, the current extent of the loop is sensed and the feed speed at the web feed unit 12 is correspondingly altered.

Figure 2:
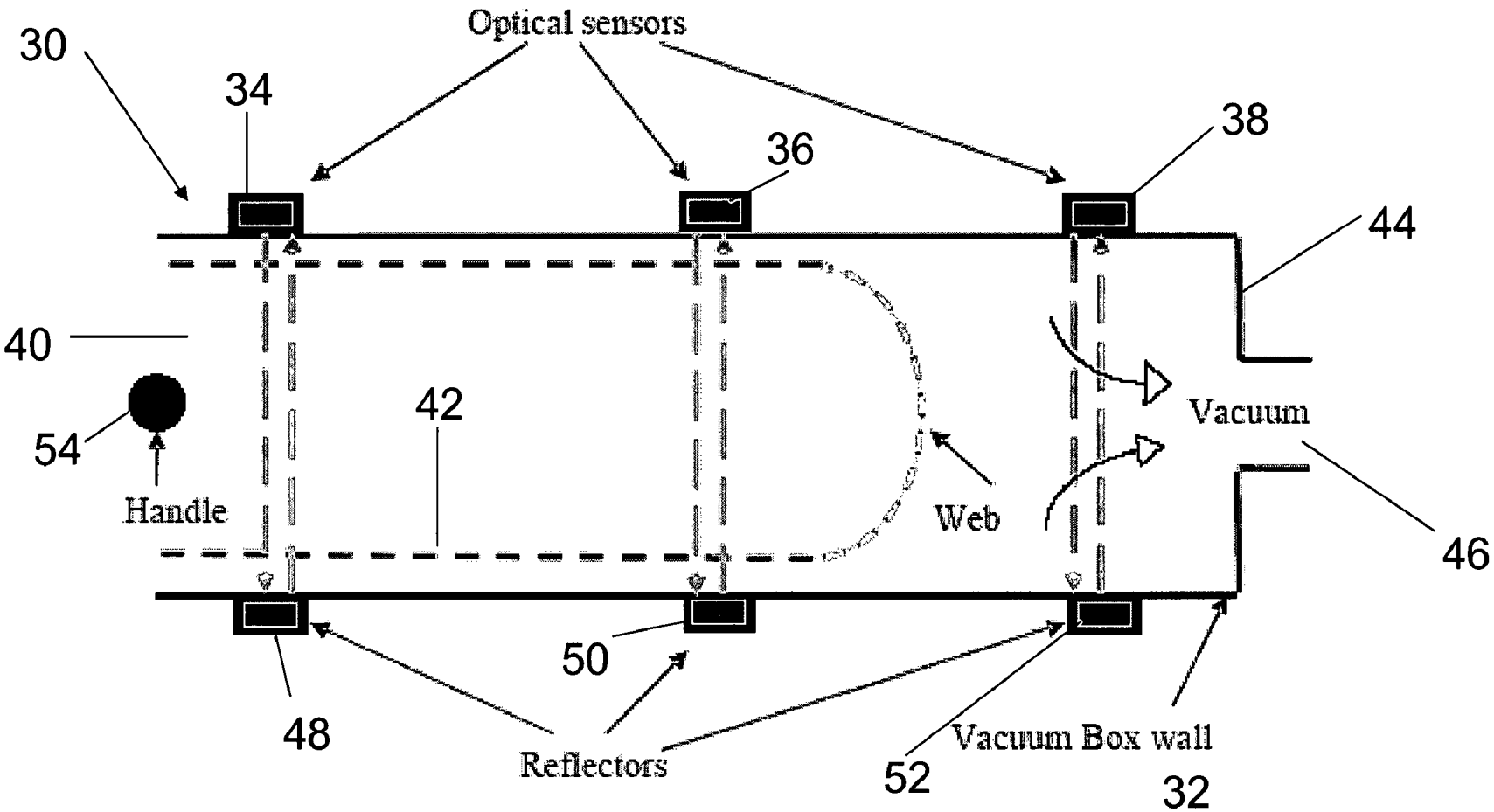
Fig. 2 Prior Art
FIG. 2 is a simplified block diagram showing a prior art vacuum box for providing buffering within the web feed and utilization system of FIG. 1.

Reference is now made to FIG. 2, which is a simplified diagram illustrating a longitudinal cross section of a prior art buffer module for use in the system of FIG. 1. The buffer module is in the form of a vacuum box 30 which has an exterior 32. On an upper side of the exterior 32 are incorporated three optical sensors 34, 36 and 38.

A first end 40 of the vacuum box 30 is open and web 42 is looped through the opening into the interior of the box. The second, facing end 44 of the box is closed except for outlet 46 which is connected to a vacuum source.

Opposite the optical sensors 34, 36 and 38 are reflectors 48, 50 and 52 which reflect light back to the sensors unless occluded by the web.

Handle 54 is present at the first end 40 of the vacuum box and the web is looped through the handle.

In use the web 42 is drawn into the interior of the vacuum box by air flow associated with the vacuum source. The extent of drawing in of the web is detected at three separate locations defined by the three sensors 34, 36 and 38. Sensor 34 is a proximal sensor for sensing a minimal extent of the loop. Sensor 36 is a medial sensor for sensing the median position of the loop and sensor 38 is a far sensor for sensing the maximal position of the loop.

As explained above, the web is sensed when the substrate occludes the reflectors. Difficulties arise when the web comprises transparent material.

Figure 3:
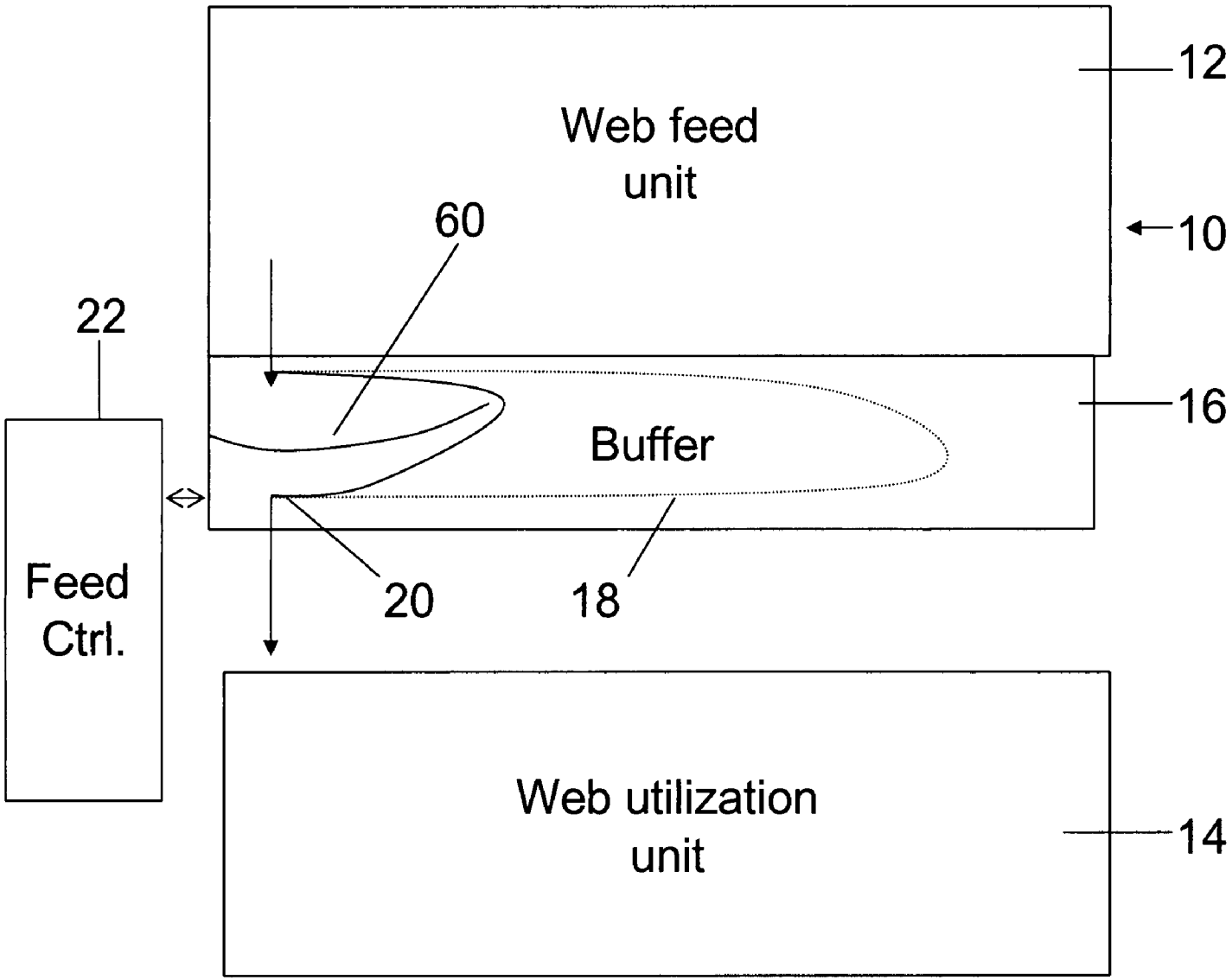
FIG. 3 is a simplified block diagram illustrating a web feed and utilization system with buffering according to a first embodiment of the present invention.

Reference is now made to FIG. 3 which is a simplified block diagram illustrating a web feeding and utilization system in accordance with a first embodiment of the present invention. Parts that are the same is in FIG. 1 are not described again except as needed for an understanding of the present embodiment.

In FIG. 3 an opaque strip 60 is inserted into the buffer module 16 within the loop formed by the web. The opaque strip floats within the buffer module to the extent allowed by the loop and serves to occlude the sensors even when the web is transparent. Thus the sensitivity of the sensors is substantially unaffected by the optical density or transparency of the web material.

Figure 4:
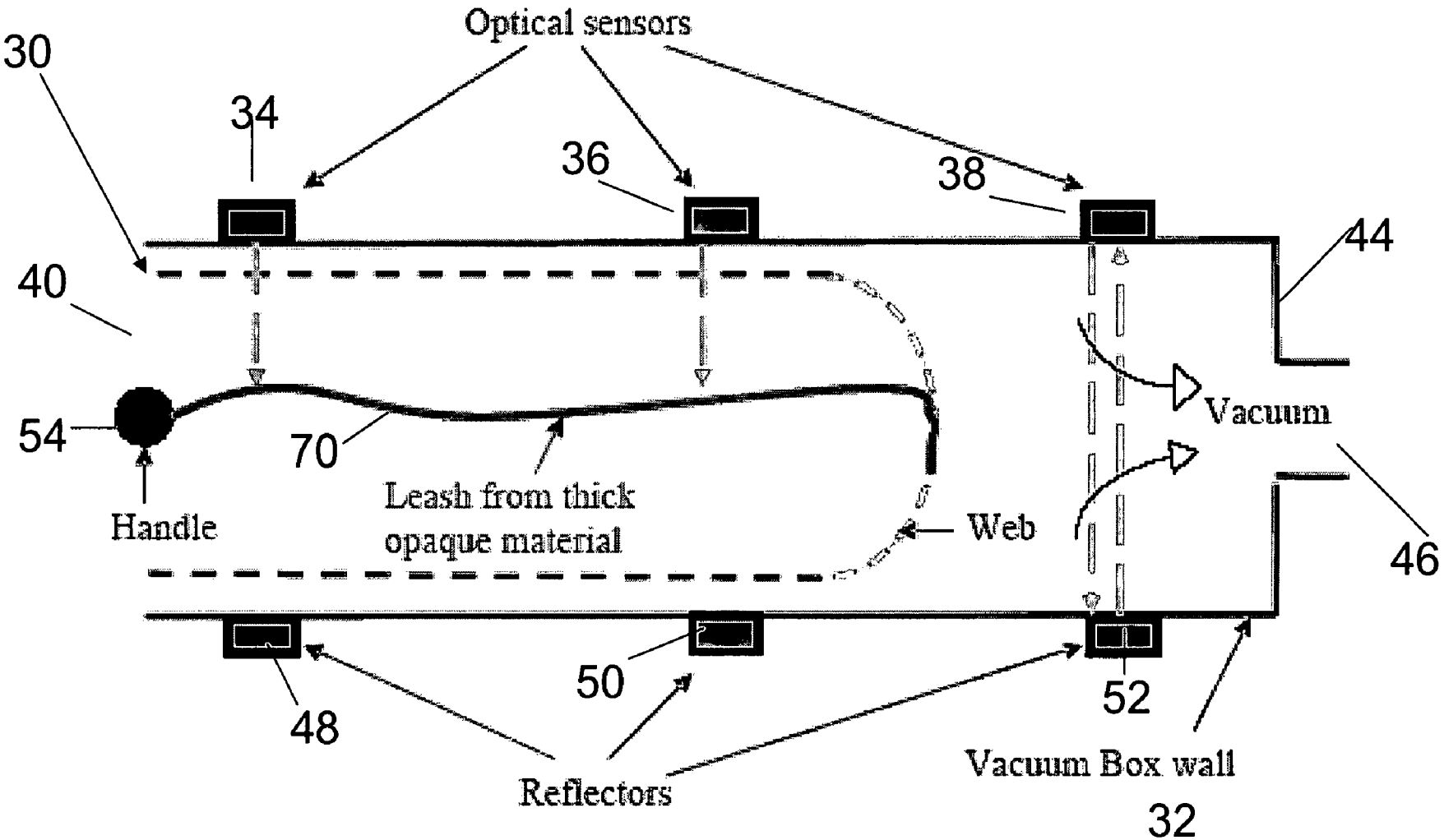
FIG. 4 is a simplified block diagram showing a vacuum box for providing buffering with the web feed and utilization system of FIG. 3.

Reference is now made to FIG. 4, which is a simplified diagram showing a vacuum box modified to provide the buffer module of FIG. 3. Parts that are the same as shown in FIG. 2 are given identical reference numerals and are not described again except as needed for a discussion of the present embodiments. Opaque extensor 70 is attached at one end to handle 54. The second end of the extensor is left free and allowed to extend within the loop inside the vacuum box

30. The extensor is preferably a strip or leash of heavily opaque material which is light enough to be drawn by the air flows within the vacuum box.

In use the extensor is drawn by the vacuum within the box to the full extent allowed by the loop of web and ensures that the optical sensors are occluded within the extent of the loop irrespective of the transparency level of the web itself.

Using the opaque extensor 70 it is possible to provide a web feed unit that can work with a wide range of web substances including thin and transparent substances and without needing any adjustment when changing from a transparent web to an opaque web.

It is expected that during the life of this patent many relevant devices and systems will be developed and the scope of the terms herein, particularly of the terms "optical sensor" is intended to include all such new technologies a priori.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents, and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. Apparatus for buffering a web of material, the apparatus comprising:

a vacuum box that defines a void into which the web can be drawn under a vacuum an optical sensor associated with the vacuum box adapted to sense opaque objects within the void; and an opaque extensor having a free end, the extensor being adapted to be extended under the force of the vacuum to an extended state at which the free end contacts the web once it has been drawn into the void, wherein the opaque extensor floats within the web such that only the free end of the extensor contacts the web.

2. The apparatus of claim 1, wherein the opaque extensor is a strip of opaque material that terminates at the free end.

3. The apparatus of claim 1, wherein the opaque extensor is a leash of opaque material that terminates at the free end.

4. The apparatus of claim 1, wherein the opaque extensor extends from a handle positioned adjacent an open end of the vacuum box.

5. The apparatus of claim 1, further comprising a reflector positioned opposite the optical sensor that is adapted to reflect light back to the optical sensor.

6. The apparatus of claim 1, wherein the apparatus comprises three optical sensors, a proximal sensor positioned nearest an open end of the vacuum box at which the web enters the void, a far sensor positioned farthest from the open end of the vacuum box, and a medial sensor positioned between the proximal and far sensors.

7. A method for detecting buffering a web of material, the method comprising:

drawing the web into a void of a vacuum box under the force of a vacuum;

extending an opaque extensor inside the web under the force of the vacuum to an extent at which a free end of the extensor contacts the web, wherein extending the opaque extensor comprises extending the extensor such that it floats within the web with only the free end of the extensor contacting the web; and sensing the presence of the opaque extensor within the void using an optical sensor associated with the vacuum box to indirectly detect the presence of the web within the void.

8. The method of claim 7, wherein extending the opaque extensor comprises extending the extensor from a handle positioned adjacent an open end of the vacuum box.

9. The method of claim 7, wherein the opaque extensor is a strip of opaque material that terminates at the free end.

10. The method of claim 7, wherein the opaque extensor is a leash of opaque material that terminates at the free end.

* * * * *

UNITED STATES PATENT AND TRADEMARK OFFICE

CERTIFICATE OF CORRECTION

PATENT NO. : 7,645,979 B2
APPLICATION NO. : 11/406711
DATED : January 12, 2010
INVENTOR(S) : Ziv Rozenblum et al.

It is certified that error appears in the above-identified patent and that said Letters Patent is hereby corrected as shown below:

In column 5, line 43, in Claim 1, after "vacuum" insert -- ; --.

Signed and Sealed this

Thirteenth Day of July, 2010

David J. Kappos

David J. Kappos
*Director of the United States Patent and Trademark Office*